United States Patent [19]

Clausen

[11] Patent Number: 4,848,053

[45] Date of Patent: Jul. 18, 1989

[54] BUILDING CONSTRUCTION ASSEMBLY INCLUDING A LAMINATED SUPPORT BEAM FOR A GLAZED STRUCTURE

[76] Inventor: Charles K. Clausen, 7094 Stone Ct., Worthington, Ohio 43085

[21] Appl. No.: 32,188

[22] Filed: Mar. 30, 1987

[51] Int. Cl.[4] ..... E04B 5/52; E04F 19/06

[52] U.S. Cl. ..... 52/397; 52/730; 52/483

[58] Field of Search ..... 52/729–731, 52/642, 86, 90, 92, 397, 483

[56] References Cited

U.S. PATENT DOCUMENTS 3,445,325 5/1969 Clark ..... 52/727

4,583,333 4/1986 Minter ..... 52/90

FOREIGN PATENT DOCUMENTS 120567 11/1945 Australia ..... 52/642

*Primary Examiner*—James L. Ridgill, Jr.

*Attorney, Agent, or Firm*—Porter, Wright, Morris & Arthur

[57] ABSTRACT

A building system and a structural improvement to the construction of glazed structures such as sun rooms, solariums and greenhouses which use laminated structural beams made of thin unfinished lamina layers of wood and surfaced on three sides with decorative finished lamina for appearance. The laminate material is made with the grain of the wood in the lamina all running parallel with the length of the beams, thereby increasing the strength of the beams and allowing the use of beams smaller in width and depth. The gazed structure includes methods of connection between the beams and the glazing and methods of incorporation of design features such as a knee wall.

6 Claims, 5 Drawing Sheets

BUILDING CONSTRUCTION ASSEMBLY INCLUDING A LAMINATED SUPPORT BEAM FOR A GLAZED STRUCTURE

FIELD OF THE INVENTION

This invention relates to the methods of construction assembly for greenhouses, sun rooms, solariums and other glazed structures and the laminated materials used therein for support and structural beams.

BACKGROUND OF THE PRIOR ART

Construction of glazed structures can involve the use of a wide variety of materials and methods, representing each builder's particular variations in procedures and preference. Most such variations reflect obvious choices of alternatives which exist in the prior art of constructing such structures. Common to most such structures is a skeletal framework of parallel support beams forming the outline of the portion to be glazed with additional beams spaced according to the integrity desired. Glazing is then attached to the supporting beam members thereby enclosing the structure.

Problems occurring in the art include the cost of materials used in the structures which in turn make the total cost of the structure prohibitive to many potential purchasers. Another problem is the ability to construct the structure in a way which satisfies both the integrity requirements of local building codes and the aesthetic characteristics desired. Support beams comprising aluminum are often used allowing the beams to be small in width and depth, but lacking the attractive appearance of wood. Wood and wood laminates are also used, but to achieve the integrity necessary for the structure, support beams of wood and laminates are usually too bulky to achieve the most pleasing appearance. Also regarding appearance, problems exist in the art with the development and inclusion of designs and methods of construction resulting in desired features of the structures, such as a knee wall, which satisfy local building codes and have an attractive appearance.

OBJECTS OF THE INVENTION

It is a principal object of this invention to provide glazed structures which are more attractive and of sufficient integrity by using materials of a laminate composition which are of greater strength in the necessary dimensions than those laminate materials previously used in the construction of glazed structures, thereby allowing the attractive appearance of wood through the use of support beams with a width and depth small enough to create the most desirable appearance.

It is also an object of the invention to provide glazed structures which include desirable design features while retaining the integrity of the structure required by the local building codes.

It is also an object of the invention to use a laminate material which, while superior to laminates previously used in the art, is less expensive and can, therefore, reduce the cost of materials needed to construct a glazed structure.

DESCRIPTION OF PREFERRED EMBODIMENT

A building system for the on-site assembly of a glazed structure including a support member for the structure comprising a rectangular laminated wood beam consisting of a plurality of longitudinally extending relatively thin wood lamina extending the length of the beam, said beam having at least three finished surfaces in which a decorative laminate is applied to both sides of the beam and to one edge thereof, the other edge of said beam being disposed facing outward from the structure, said beam being the support member for an adjacent glazing plane whereby the three finished surfaces of the beam face inwardly in the structure and present a decorative appearance thereto and the longitudinally extending lamina are oriented perpendicularly to the glazing surface.

The system described above in which the beam is the approximate size of a standard construction grade beam member and comprises through its thickness approximately 20 lamina, each having an individual thickness of approximately 0.10 inches.

The system described above in which the direction of the grain of the wood of each of the lamina in the beam is parallel to the direction of the grain of the wood in all the other lamina.

The system described above in which the support members are used in the construction in such an orientation that the planes formed by the lamina are perpendicular to the planes formed by the glazing.

In a glazed structure assembly, the improvement comprising a building system for the on-site assembly of a glazed structure including a support member for the structure comprising a rectangular laminated wood beam consisting of a plurality of longitudinally extending relatively thin wood lamina extending the length of the beam, said beam having at least three finished surfaces in which a decorative laminate is applied to both sides of the beam to one edge thereof, the other edge of said beam being disposed facing outward from the structure, said beam being the support member for an adjacent glazing pane whereby the three finished surfaces of the beam face inwardly in the structure and present a decorative appearance thereto and the longitudinally extending lamina are oriented perpendicularly to the glazing surface.

The assembly described above in which the glazing member is supported with a single or, preferably, double glazed glass windowpane mounted in an extruded member supported by the beam.

The assembly described above in which the extruded member is mounted in a groove in the unfinished side edge of the beam.

The assembly described above in which the groove includes a dovetail shaped female channel adapted to receive a corresponding male shaped formed in the extruded member.

The assembly described above in which the beams are a side wall column support and a roof rafter support.

The assembly described above in which the side wall column support beam is an intrinsic element of a knee wall in which the beam extends from the floor to the extending end of the rafter.

Figure 1:
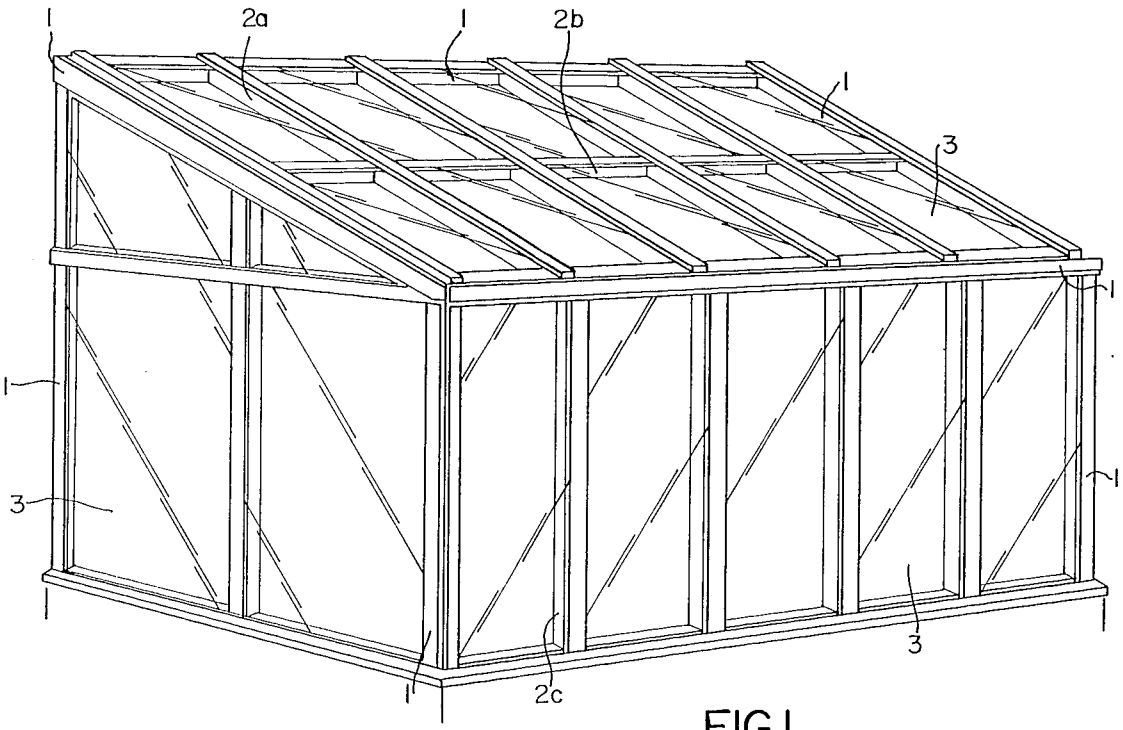
FIG. 1 is a perspective view of a glazed structure showing the skeletal structure of the laminate material and the glass used to enclose the structure.

Referring to FIG. 1, the present invention includes a building system and a glazed structure formed from the skeletal structural beams 1, the horizontal and vertical support beams 2*a* and 2*c*, and crossbeams 2*b* and the glazing 3. All of the structural beams 1 and support beams 2*a* and 2*c* comprise the laminate material described in FIG. 3. The glazing 3 comprises any glass or other transparent or semi-transparent material satisfying the integrity requirements necessary under the local building codes.

Figure 2:
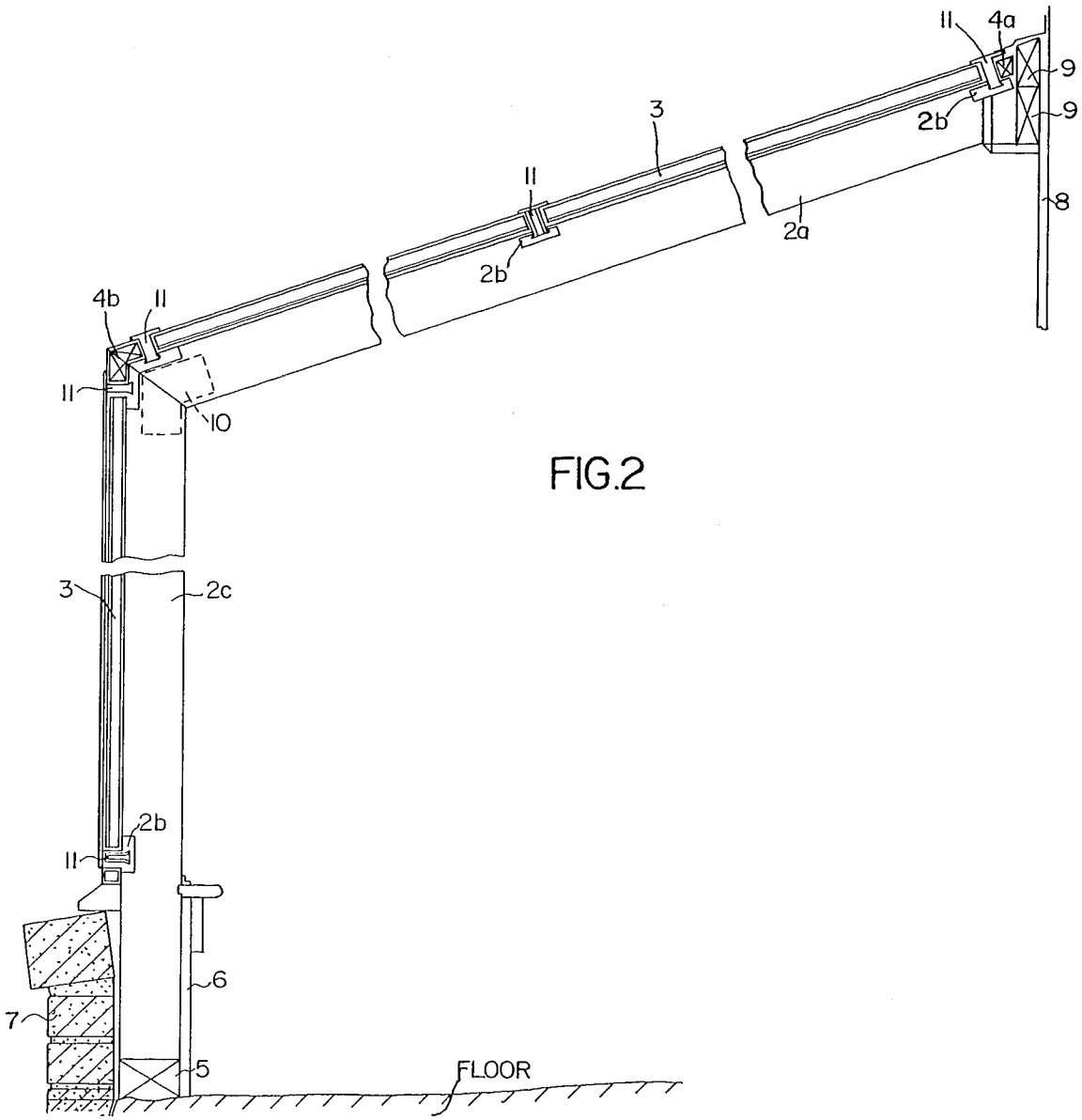
FIG. 2 is a side cross-sectional view of a glazed structure showing the interconnection of the sections of glazing, the connection to the supporting building, the connection of the vertical and horizontal support beams, and the continuity of the horizontal support beam when a knee wall is incorporated.

Referring to FIG. 2, the supporting building 8 is connected to the glazed structure by means of a header plate 9 and a universal spacer 4*a*. Extending outward from the supporting building 8, primarily horizontally with a downward inclination, the support beams 2*a* extend the full depth of the glazed structure and connect to the vertical support beams 2*c* by means of a spline plate 10. The vertical support beams 2*c* connect to a wood bottom plate 5 which in turn connects to the floor or foundation. A knee wall having a finished interior is shown at 6, and on the exterior a brick wall 7 is shown. The glazing 3 is attached to the exterior of the horizontal and vertical support beams 2*a* and 2*c* and to the crossbeams 2*b*, and is held in place by vinyl connector units 11. The number of cross beams 2*b* and support beams 2*a* and 2*c* may vary depending upon factors such as the size of glazed structure, the integrity required and the glazed structure's appearance.

Figure 3:
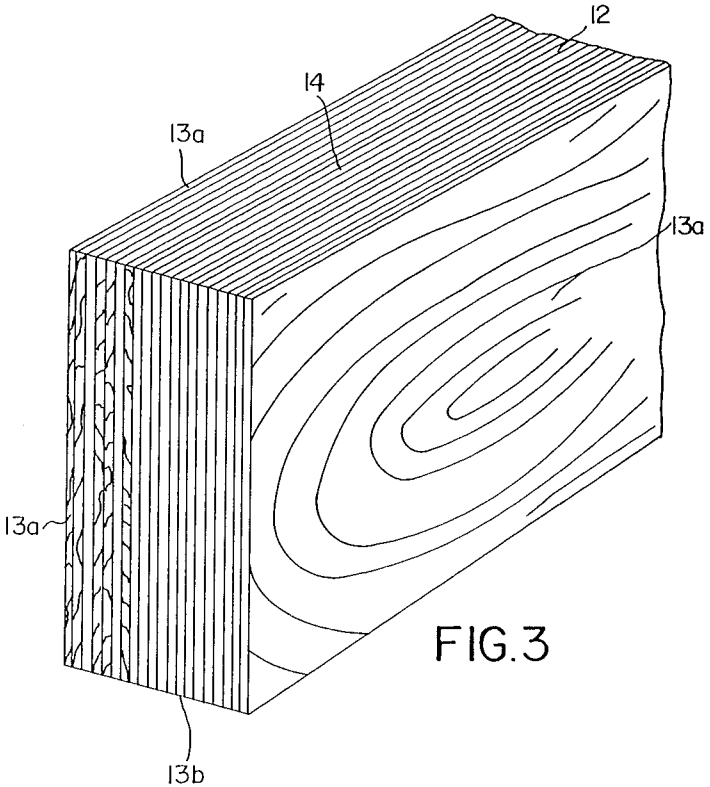
FIG. 3 is a perspective view of the laminate material showing the multiple unfinished lamina and the layer of finished lamina on two sides and one edge.

Referring to FIG. 3, the drawing shows a perspective view of the laminate material of the invention used for the structural beams 1, and the support beams 2*a* and 2*c*. The laminate material for a standard inch and three-quarters construction laminated structural member comprises approximately twenty lamina 12, made of thin layers of unfinished wood and adhesives. Dissimilar to other laminate and plywood materials, each of the lamina 12 of the laminate material used in the invention is joined with the grain of the wood in each layer running the same direction, that direction being parallel with the length of the laminated structural member and perpendicular to the direction of the stacking of the layers. The unidirectional grain of the wood gives the laminated structural member greater strength in the direction of the planes formed by each of the lamina 12. The laminate material is used in the construction of the glazed structures with the planes formed by the lamina 12 perpendicular to the planes formed by the glazing 3, thereby utilizing the increased strength of the unidirectional lamina 12 and allowing the use of such structural and support beams 1, 2*a* and 2*c* to achieve the mose desirable appearance with the required integrity. A preferred commercial laminate from which the laminated structural members of the invention are made is sold as "Micro:Lam" TM by Trus Joist Corporation.

To achieve the desirable appearance, layers of finished decorative laminate 13*a* and 13*b* are connected to the two sides 13*a* and one edge 13*b* of the laminated structural members. The three finished sides face inward and can be seen in the final structure. The unfinished side 14 faces the glazing and cannot be seen from the interior of the finished structure.

Figure 4A:
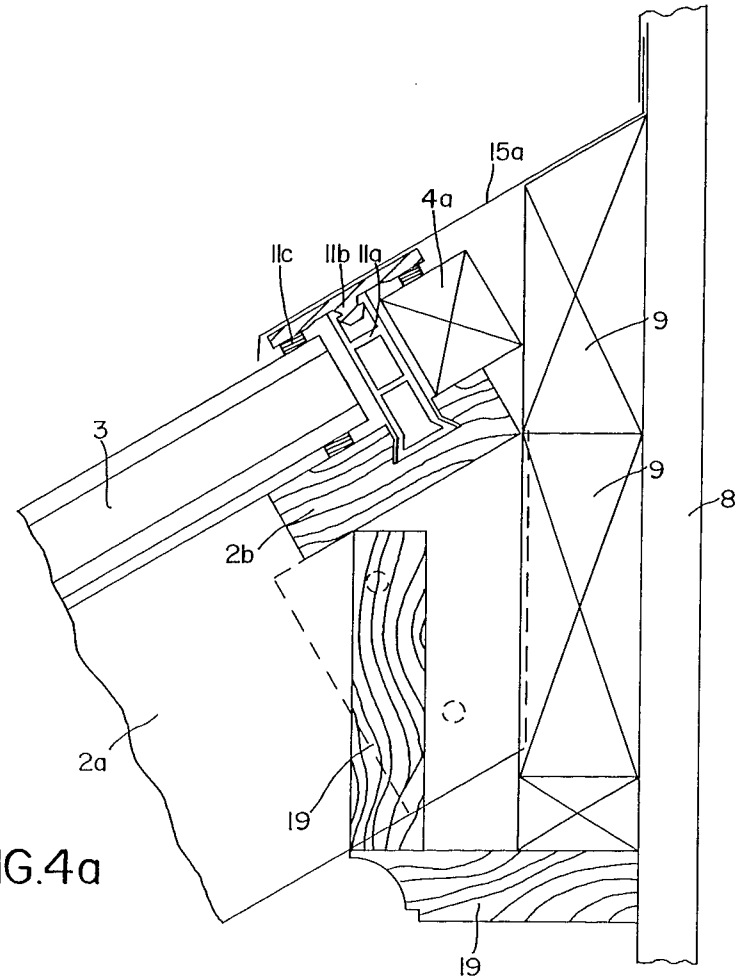
FIGS. 4(*a*), 4(*b*) and 4(*c*) are three cross-sectional views of the connection of the glazing to the supporting building, between the horizontal and vertical support beams and the knee wall assembly, each showing the dovetail channel connector.
Figure 4C:
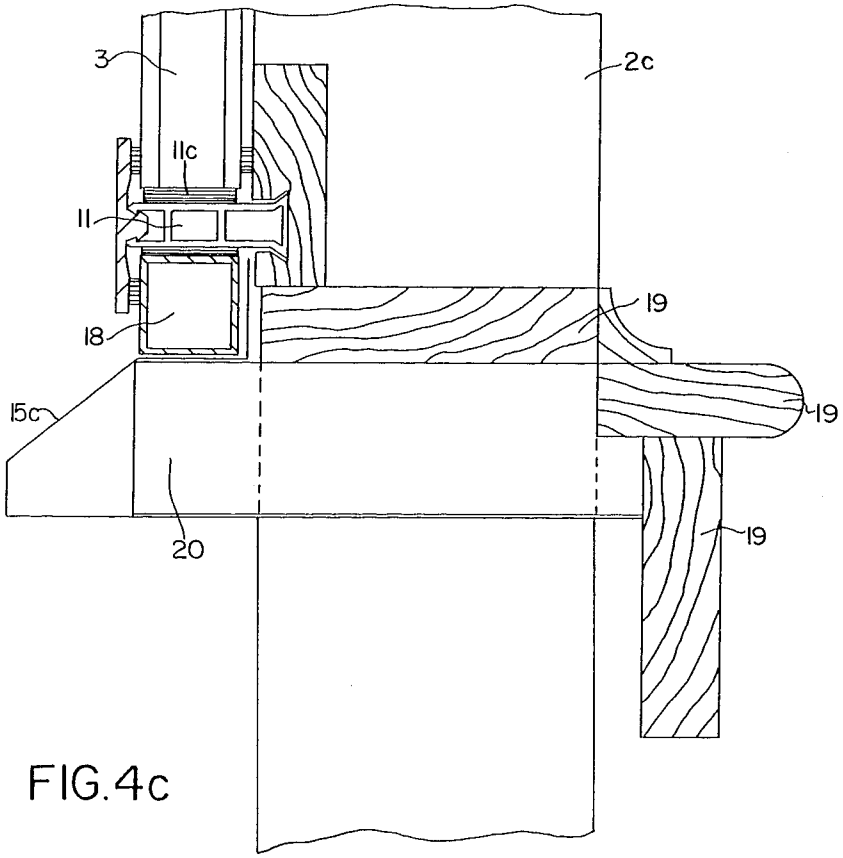
Figure 4B:
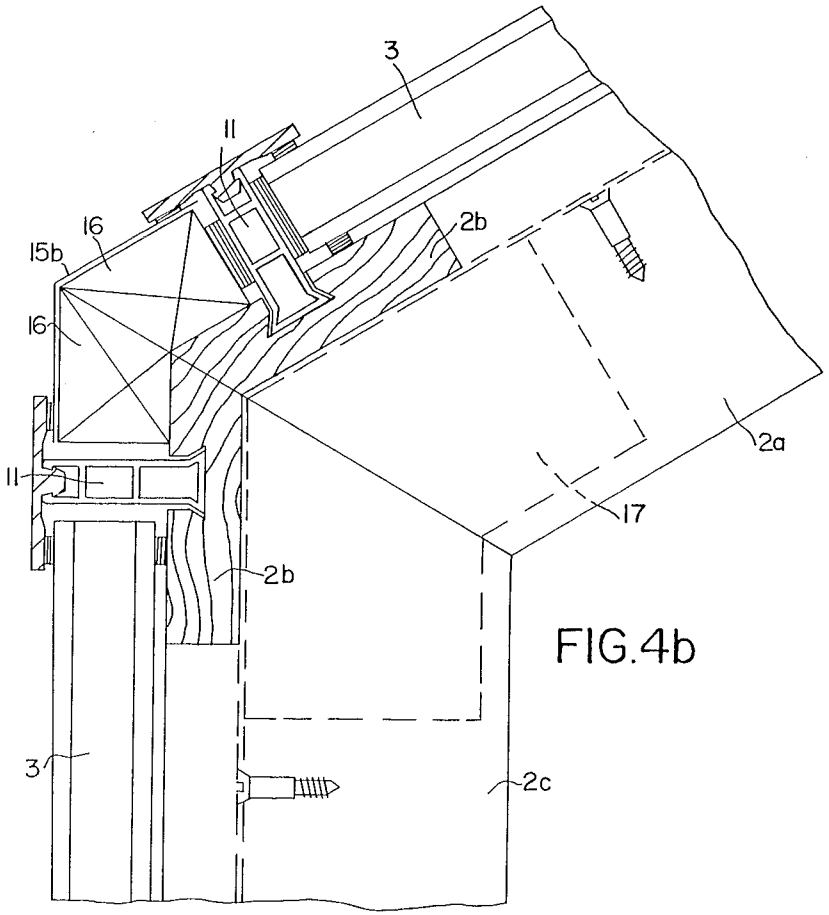

Referring to FIG. 4(*a*), the cross-sectional view of the connection between the supporting building 8 and the glazed structure shows the connection between the glazing 3 and the header plate 9 which is accomplished through the use of the vinyl connector units 11 comprising a vinyl connector 11*a*, a bar cap 11*b*, and neoprene glazing pads 11*c*. The vinyl connector is joined to an wood crossbeam 2*b* by means of a dovetail female channel running the length of the crossbeam 2*b* and a dovetail male formation at one end of the vinyl connector 11*a*. The glazing 3 and universal spacer 4*a* are then placed on the sides of the vinyl connector 11*a*, with the glazing 3 being separated from the wood crossbeams 2*b* with a neoprene glazing pad 11*c*. The unit is then sealed with a bar cap 11*b* having a male lock-clasp protruding member which is inserted into the female lock-clasp cavity on the edge of the vinyl connector 11*a* opposite the male dovetail formation. The glazng 3, universal spacer 4*a* and the bar cap 11*b* are similarly separated by neoprene glazing pads.

A flashing 15*a* is connected to the supporting building 8 and extends over and covers the bar cap 11*b* and empties onto the glazing 3.

The wood crossbeam 2*b* is connected to the support beams 2*a* which are in turn connected to the header plate 9. In the interior of the glazed structure the header plate 9 and the end of the support beams 2*a* and crossbeams 2*b* are covered with decorative wood trim 19.

Referring to FIG. 4(*b*), the cross-section shows the assembly of the connection between the vertical and horizontal sides of the glazed structure. Similar to FIG. 4(*a*) the glazing 3 is connected to the crossbeam 2*b* by means of the vinyl connector unit 1. The vertical and horizontal vinyl connector units 11 are connected to a common treated wood blocking 16 which is angled to accommodate both vinyl connector units 11. The wood blocking 16 is covered with a knee flashing 15*b*. The glazed assembly is connected to the horizontal and vertical support beams 2*a* and 2*c*, said beams being connected to each other with a spline plate 7.

Referring to FIG. 4(*c*), the cross-section shows the connection between the glazed portion of the structure and an optional knee wall 6. The glazing 3 is connected to a vinyl connector unit 11 which is connected on its opposite side to a square aluminum tube 18. As in FIG. 4(*a*) and FIG. 4(*b*), the vinyl connector unit 11 is connected to a crossbeam 2*b* by means of a dovetail connector track. The aluminum tube 18 is connected to a sill plate insert 20 which is covered on the exterior by a sill flashing 15*c* and on the interior by decorative wood trim 19. The glazed assembly is attached to the vertical support beam 2*c* which is attached to the crossbeam 2*b* and the sill plate insert 20.

Figure 5:
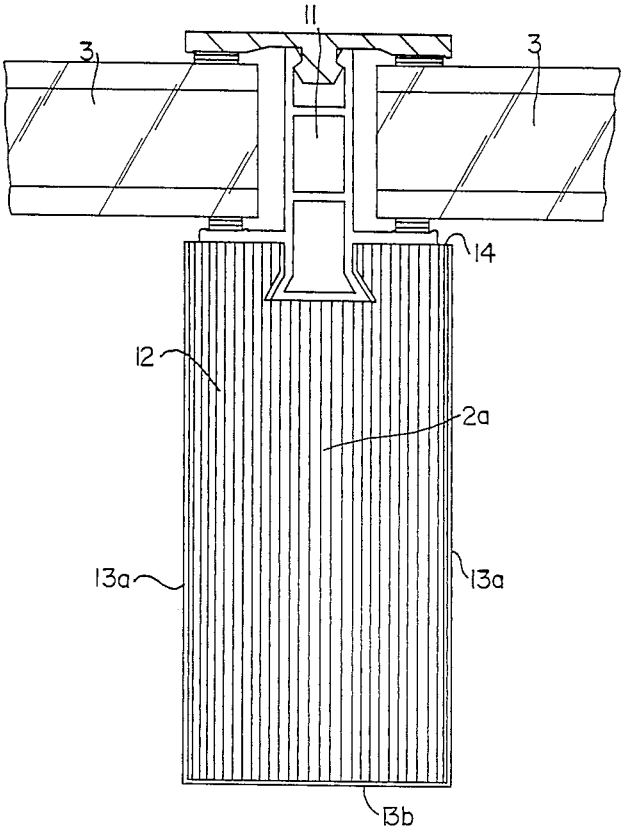
FIG. 5 is a cross-sectional view of a support beam showing the dovetail channel connector.

Referring to FIG. 5, the cross-section shows the connection of the two sections of glazing 3 to the support beams 2*a* and 2*c*. As with the connections in FIG. 4, the connection of the glazing 3 to the support beams 2*a* and 2*c* employs a vinyl connector unit 11. The female dovetail channel 25 in the laminated structural and support beams 1, 2*a*, and 2*c* extends the length of the beams for receipt of the protruding male dovetail member 11*a* of the vinyl connector unit 11. The unfinished surface of the beams 14 faces the glazing, and the two sides and the opposite edge of the support beams 13*a* and 13*b* are a finished decorative laminate and face the interior of the glazed structure. The lamina 12 of the beams, having a unidirectional grain of the wood layers, provide additional strength along the plane formed by the lamina 12 and allow the support beams to be of small enough width and depth to achieve the most desirable appearance.

I claim:

1. A building system for the on-site assembly of a glazed enclosure structure which forms a room-like building section including:

a support member for the structure comprising a rectangular cross-sectioned laminated wood beam of a standard construction grade size consisting of a plurality of longitudinally extending relatively thin wood lamina each having an individual thickness of approximately 0.10 inch in which the direction of grain of each lamina extends in the same direction extending the length of the beam said beam having at least three finished surfaces in which a decorative laminate is applied to both longitudinally extending sides of the beam and to one longitudinally extending edge thereof and said sides and edge face the interior of the room-like building section, the other longitudinally extending edge of said beam being disposed facing outward from the structure and including attachment means for the attachment of glazing thereon, said beam forming the support member for an adjacent glazing pane attached to the attachment means, whereby the three finished surfaces of the beam face inwardly in the structure and present a decorative appearance thereto;

and further in which the longitudinally extending lamina of the beam are oriented perpendicularly to a plane formed by the glazing surface of the pane.

2. An assembly of claim 1 in which the glazing member is a double glaze windowpane mounted in an attachment means which is an extruded member secured to the outward facing edge of the beam.

3. The assembly of claim 2 in which the extruded member is mounted in a groove in the outward facing edge of the beam.

4. The assembly of claim 3 in which the groove includes a dovetail shaped female channel adapted to receive a corresponding male shape formed in the extruded member.

5. The assembly of claim 1 or claim 2 or claim 3 or claim 4 including a floor and a plurality of beams in which a first group of beams are spaced apart and form a side wall column support extending from the floor and a second group of beams secured to the first group of beams form a roof rafter support for a room-like building structure, and glazing panels are mounted adjacent the outer facing edges of the beams.

6. The assembly of claim 5 in which the side wall column support beam includes as an intrinsic element a knee wall extending from the floor from which the beam extends to the extending end of the rafter.

* * * * *